US007427827B2

(12) United States Patent
Hirasawa et al.

(10) Patent No.: US 7,427,827 B2
(45) Date of Patent: Sep. 23, 2008

(54) IMAGE DISPLAY DEVICE AND MANUFACTURING METHOD OF THE SAME

(75) Inventors: Shigemi Hirasawa, Chiba (JP); Yuichi Inoue, Mobara (JP); Akira Hatori, Chiba (JP)

(73) Assignee: Hitachi Displays, Ltd., Chiba (JP)

( * ) Notice: Subject to any disclaimer, the term of this patent is extended or adjusted under 35 U.S.C. 154(b) by 94 days.

(21) Appl. No.: 11/332,913

(22) Filed: Jan. 17, 2006

(65) Prior Publication Data

US 2006/0158093 A1 Jul. 20, 2006

(30) Foreign Application Priority Data

Jan. 19, 2005 (JP) ..... 2005-011404

(51) Int. Cl.
*H01J 1/88* (2006.01)
*H01J 19/42* (2006.01)
*H01K 1/18* (2006.01)

(52) U.S. Cl. ..... 313/292; 313/495; 313/238; 313/268; 313/250

(58) Field of Classification Search ..... 313/495, 313/292, 238, 268, 250
See application file for complete search history.

(56) References Cited

U.S. PATENT DOCUMENTS

| | | | | |
|---|---|---|---|---|
| 4,769,575 | A * | 9/1988 | Murata et al. | 313/495 |
| 6,225,737 | B1 | 5/2001 | Pong et al. | |
| 6,274,972 | B1 | 8/2001 | Mitsutake et al. | |
| 6,441,544 | B1 * | 8/2002 | Ando et al. | 313/310 |
| 6,777,868 | B1 * | 8/2004 | Kosaka et al. | 313/495 |
| 2004/0227453 | A1 * | 11/2004 | Ando et al. | 313/495 |

FOREIGN PATENT DOCUMENTS

| | | |
|---|---|---|
| JP | 3305166 | 10/2002 |

* cited by examiner

*Primary Examiner*—Peter Macchiarolo
(74) *Attorney, Agent, or Firm*—Milbank, Tweed, Hadley & McCloy, LLP

(57) ABSTRACT

To allow an image display device which includes a plurality of distance holding members (spacers) which are arranged in the inside of a display region to acquire a prolonged lifetime, high brightness and high reliability while preventing charging of the spacers, a conductive film is arranged on a bottom surface of the spacer and the conductive film is covered with an adhesive material.

10 Claims, 6 Drawing Sheets

IMAGE DISPLAY DEVICE AND MANUFACTURING METHOD OF THE SAME

BACKGROUND OF THE INVENTION

1. Field of the Invention

The present invention relates to a planar image display device which makes use of the emission of electrons into a vacuum formed between a face substrate and a back substrate, and more particularly to an image display device which arranges a plurality of distance holding members in the vacuum formed between both substrates.

2. Description of the Related Art

A color cathode ray tube has been popularly used conventionally as an excellent display device which exhibits high brightness and high definition. However, along with the realization of high image quality of recent information processing device and television broadcasting, there has been a strong demand for a planar image display device (flat·panel·display, FPD) which is light-weighted and requires a small space for installation while ensuring the excellent properties such as high brightness and high definition.

As typical examples of such a planar image display device, a liquid crystal display device, a plasma display device or the like has been put into practice. Further, particularly with respect to the planar display device which can realize the high brightness, with respect to a self luminous display device which makes use of emission of electrons into vacuum from electron sources, various planar image display devices such as an electron emission type image display device, a field emission type image display device, an organic EL display which are characterized by low power consumption and the like are expected to be put into practice in near future.

Among these planar image display devices, with respect to the self-luminous flat panel display, there has been known a display device having the constitution in which electron sources are arranged in a matrix array, wherein as one such display, there has been also known the above-mentioned electron emission image display device which makes use of minute and integrative cold cathodes.

Further, in the self-luminous flat panel display, as cold cathodes, thin film electron sources of a spindle type, a surface conduction type, a carbon nanotubes type, an MIM (Metal-Insulator-Metal) type which laminates a metal layer, an insulator and a metal layer, an MIS (Metal-Insulator-Semiconductor) type which laminates a metal layer, an insulator and a semiconductor layer, a metal-insulator-semiconductor layer-metal or the like has been used.

With respect to the MIM type electron source, for example, there has been known an electron source which is disclosed in Japanese Patent Laid-open Hei7(1995)-65710 (patent document 1) and Japanese Patent Laid-open Hei10(1998)-153979 (patent document 2), for example. Further, with respect to the metal-insulator-semiconductor electron source, there has been known an MOS type electron source reported in j. Vac. Sci. Technol. B11 (2) p. 429-432 (1993) (non-patent document 1). Further, with respect to the metal-insulator-semiconductor-metal type electron source, there has been known a HEED type electron source reported in high-efficiency-electro-emission device, Jpn. J. Appl. Phys., vol 36, pL939 (non-patent document 2), an EL type electron source reported in Electroluminescence, Applied Physics, Volume 63, No. 6, p. 592 (non-patent document 3), or a porous silicon type electron source reported in Applied Physics, Volume 66, No. 5, p. 437 (non-patent document 4).

As the electron emission type FPD, there has been known a display panel which is constituted of a back substrate which includes the electron sources described above, a face substrate which includes phosphor layers and an anode to which an acceleration voltage for allowing electrons emitted from electron sources to impinge on the phosphor layers is applied, and a support body which allows the back substrate and the face substrate to face each other in an opposed manner and constitutes a sealing frame for sealing an inner space formed by opposing surfaces of both substrates into a given vacuum state. The electron emission type FPD is operated in a state that drive circuits are combined with the display panel.

In the image display device having the MIM type electron sources, the above-mentioned back substrates includes a substrate formed of an insulation material, wherein on the substrate, a plurality of scanning signal lines which extend in one direction, are arranged in parallel in another direction which is orthogonal to one direction, and to which scanning signals are applied sequentially in another direction are formed. Further, on the substrate, a plurality of image signal lines which extend in the above-mentioned another direction and are arranged in parallel in the above-mentioned one direction to intersect the scanning signal lines are formed. The above-mentioned electron sources are formed in the vicinity of respective intersecting portions of the scanning signal lines and the image signal lines, and both lines and the electron sources are connected through energizing electrodes and hence, an electric current is supplied to the electron sources.

The individual electron source forms a pair with a corresponding phosphor layer so as to constitute a unit pixel. Usually, one pixel (color pixel) is constituted of the unit pixels of three colors consisting of red (R), green (G) and blue (B). Here, in the case of the color pixel, the unit pixel is also referred to as a sub pixel.

In the planner image display device described above, in general, in the inside of a display region which is arranged between the back substrate and the face substrate and is surrounded by the support body, a plurality of distance holding members (hereinafter referred to as spacers) are arranged and fixed thus holding the distance between the above-mentioned both substrates at a given distance in cooperation with the support body. The spacers are formed of a plate-like body which is made of an insulation material such as glass, ceramics or the like, in general. Usually, the spacers are arranged at positions which do not impede an operation of pixels for every plurality of pixels.

Further, with respect to the planner image display device, there has been proposed a display panel which connects spacers having semiconductor characteristics by connecting the spacers with electrodes in Japanese Patent 3305166 Publication (patent document 3).

Further, with respect to the planner image display device, the constitution which forms a conductive film which melts a conductive material over a bottom surface from side surfaces of a wall body has been proposed in U.S. Pat. No. 6,225,737 Specification (patent document 4).

SUMMARY OF THE INVENTION

In the related art, there has been proposed the constitution in which as a means which ensures the holding of the distance between both substrates, the electron emission type FPD includes the frame-like support body and a plurality of spacers which are arranged in the inside of the display region surrounded by the support body. The spacers are arranged in parallel to the scanning signal lines, for example, in the inside of the display region. In such a spacer arrangement, electrons irradiated from the electron sources are accelerated by a voltage applied to the anode and impinge on the phosphor layers to allow the phosphor layers to emit lights. However, some electrons charge the spacers and trajectories of the electrons irradiated from the electron sources are warped by this charging and hence, it is impossible to allow the sufficient electrons to impinge on the phosphor layers thus giving rise to a drawback that the excitation of the phosphor layers becomes insufficient. As a result, there arises the insufficient brightness or the deterioration of color reproducibility.

Further, the charging of spacers induces the deterioration of breakdown strength characteristics between both substrates thus giving rise to a drawback that the prolongation of lifetime of the electron emission type FPD is hampered.

Further, in this type of image display device, a distance between both substrates is set to a narrow distance of approximately several mm and hence, the evacuation of gas of an adhesive material which is used for fixing the spacers is liable to easily become insufficient. This becomes one of factors which make the maintenance of high vacuum difficult thus giving rise to a drawback that the prolongation of the lifetime of the electron emission type FPD is hampered also from this point of view.

As one of counter measures to cope with the drawback attributed to this charging of spacers, patent document 3 discloses the constitution in which the semiconductor characteristics are imparted to surfaces of the spacers and semiconductor films are electrically connected with conductive films which are formed on top surfaces and bottom surfaces of the spacers. However, the conductive films on the bottom surface side are exposed in the inside of the vacuum region and hence, there exists a possibility that the conductive films face the anode and are operated as one electrode thus still possessing various drawbacks such as the suppression of the irradiation of electrons, the warping of electron trajectories and the like. Here exists a demand for means which can overcome such drawbacks.

The above-mentioned drawbacks can be overcome by arranging conductive films on bottom surfaces of spacers which are fixed to electrodes on a low voltage side (back substrate side) by way of an adhesive material and by covering the conductive films with the adhesive material.

According to the present invention, by arranging conductive films on bottom surfaces of spacers on a back substrate side which constitutes a low voltage side, the charging of the spacers can be prevented, the evacuation efficiency can be enhanced, and the discharged gas is hardly reabsorbed in the inside of the panel thus ensuring the high vacuum. Further, since the conductive film is covered with the adhesive material and is not exposed to the inside of the display region, the short-circuiting with the high voltage side can be prevented thus enhancing the emission of gas whereby the evacuation efficiency is enhanced and the lifetime of the image display device is prolonged and, at the same time, the generation of sparks can be prevented thus enhancing the breakdown strength characteristics. Accordingly, it is possible to obtain the image display device of prolonged lifetime, the high brightness and the high reliability.

According to the present invention, by providing the thin film electron sources, it is possible to provide the highly reliable image display device which exhibits the beam converging property, overcomes a drawback on the contamination of surfaces of the electron sources, exhibits the excellent electron discharge characteristics, and exhibits the prolonged lifetime.

According to the present invention, by arranging the spacers in a state that the spacers are overlapped to the scanning signal lines and extend in the same direction as the scanning signal lines, it is possible to prevent damages of electrodes such as the electron sources, the image signal lines and the like.

According to the present invention, by making the adhesive material conductive, it is possible to obtain the image display device which exhibits the excellent breakdown strength characteristics by preventing the charging of the spacers.

According to the present invention, by arranging the conductive film at a position close to the back substrate on the low voltage side, it is possible to ensure the desired conduction between both substrates and hence, the charging of the spacers can be prevented, the degassing effect can be enhanced, and the discharged gas is hardly reabsorbed in the inside of the panel whereby the high vacuum can be ensured thus obtaining the image display device of prolonged lifetime, the high brightness and the high reliability.

According to the present invention, by arranging the conductive film on a portion of the bottom surface of the spacer, it is possible to manufacture the image display device at a low cost in addition to the above-mentioned advantageous effects.

According to the present invention, by allowing the conductive film to have a resistance value of 1 to 100Ω, it is possible to make the wiring resistance value approximately uniform irrespective of the presence or non-presence of the spacers and hence, the fluctuation of the characteristics attributed to the difference in the wiring resistance value can be suppressed.

According to the present invention, with the use of the conductive film which is formed of aluminum, it is possible to provide the conductive film which exhibits the stable property, and the easy handling and can be manufactured at a low cost.

According to the present invention, by allowing the spacers to have the resistance value of $10^8$ to $10^9$ Ωcm, it is possible to ensure the breakdown strength characteristics between both substrates.

According to the present invention, with the use of the spacers made of the ceramic material and having a total length of 200 mm or less, the handling of the spacers is facilitated thus ensuring a mechanical strength.

According to the present invention, with the use of the adhesive material which contains frit glass, a gas emission quantity of the adhesive material can be reduced compared to other adhesive materials and the temperature control is also facilitated.

According to the present invention, by arranging a thin film layer having conductivity lower than conductivity of the conductive film on a top surface (a portion which faces the face substrate) of the spacer and hence, the distribution of potential between both substrates can be made smooth whereby it is possible to obtain the desired electron trajectories.

According to the present invention, by locally heating the bottom surface (portion which faces the back substrate) of the spacer at the time of evacuation, the gas discharge effect is enhanced, the discharged gas is hardly reabsorbed in the inside of the panel whereby the high vacuum can be ensured thus obtaining the image display device of prolonged lifetime, the high brightness and the high reliability.

BRIEF EXPLANATION OF DRAWINGS

FIG. 1A and FIG. 1B are views for explaining one embodiment of an image display device according to the present invention, wherein FIG. 1A is a plan view as viewed from a face substrate side and FIG. 1B is a side view as viewed from the direction A of FIG. 1A;

DESCRIPTION OF THE PREFERRED EMBODIMENTS

Embodiments of the present invention are explained hereinafter.

Embodiment 1

Figure 1A:
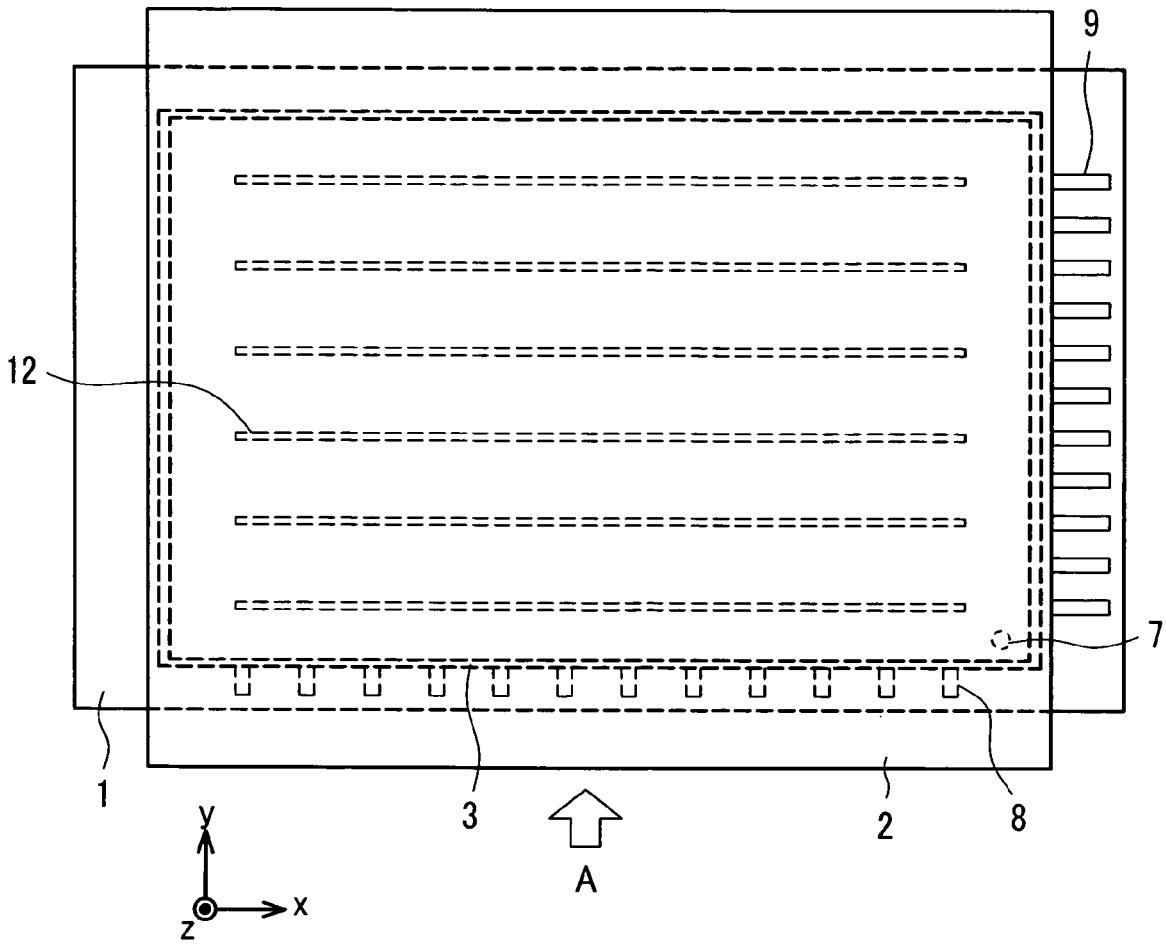
Figure 1B:
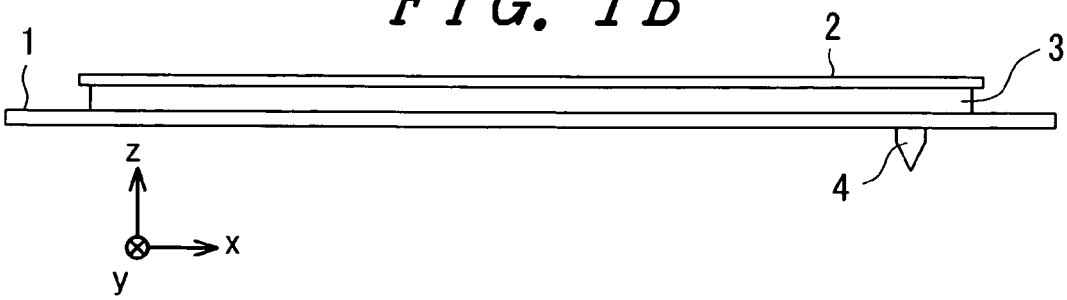
Figure 2:
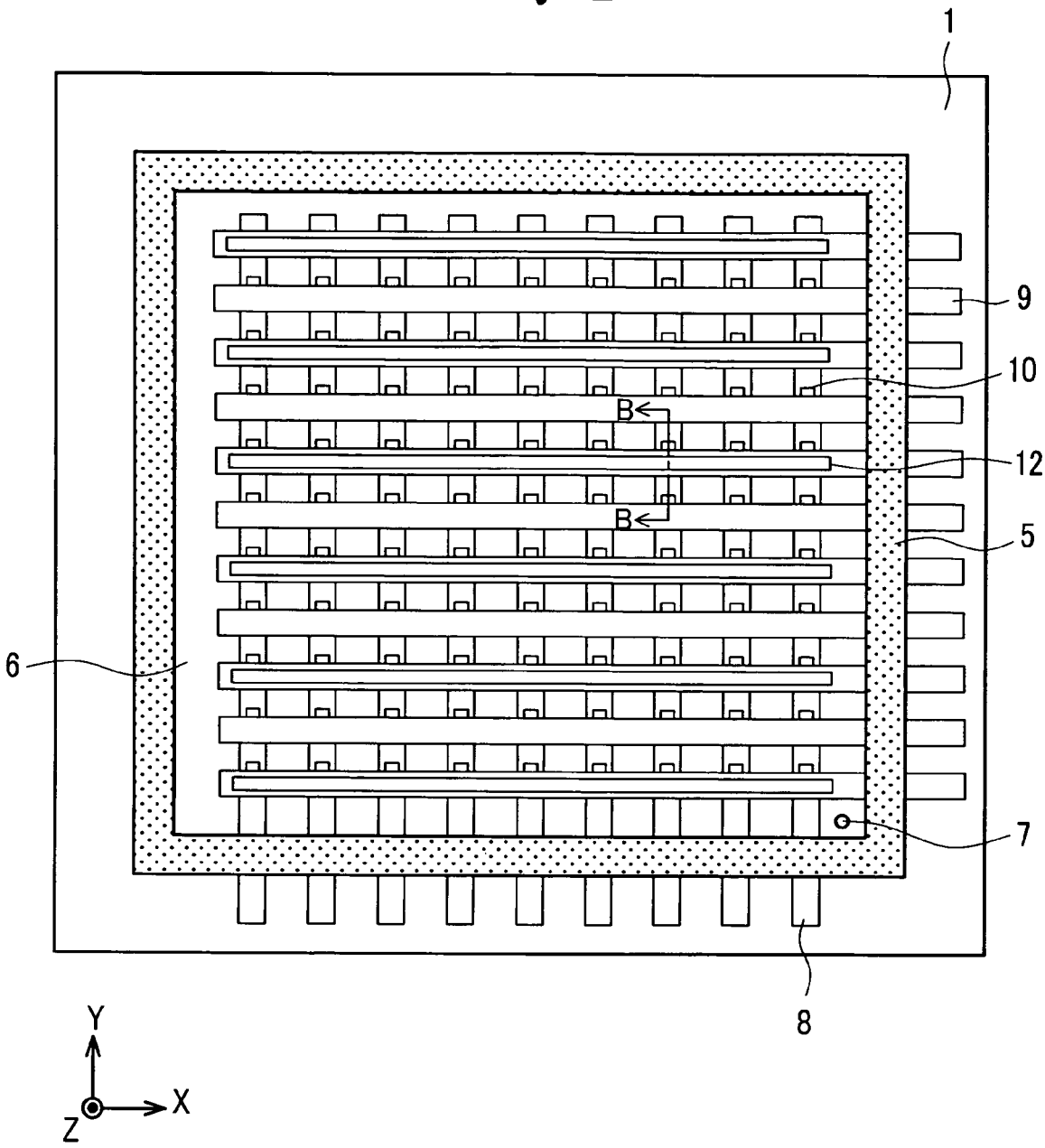
FIG. 2 is a schematic plan view of a back substrate by removing a face substrate shown in FIG. 1.
Figure 3:
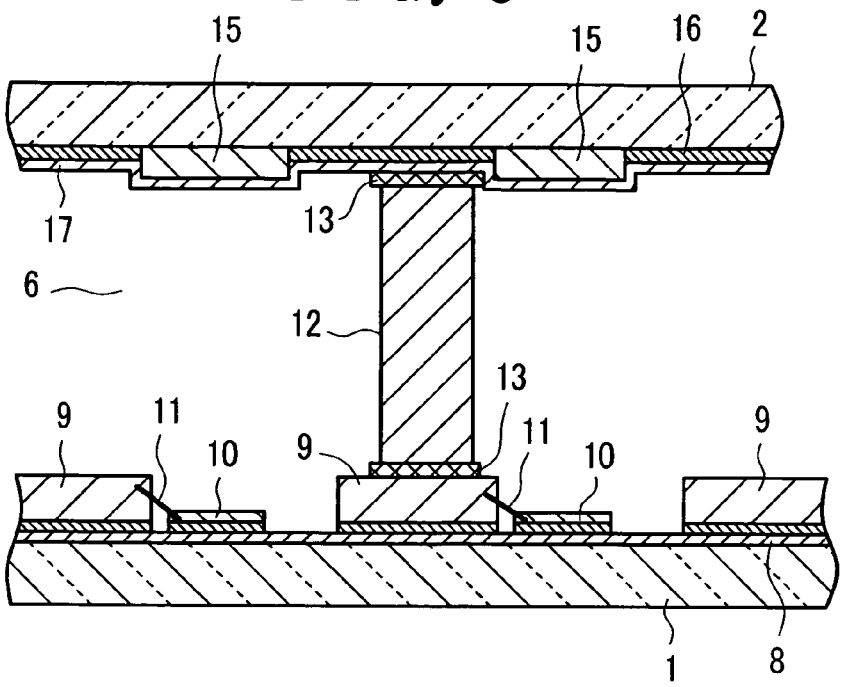
FIG. 3 is a schematic cross-sectional view of the back substrate and the face substrate corresponding to the back substrate along a line B-B in FIG. 2.
Figure 4:
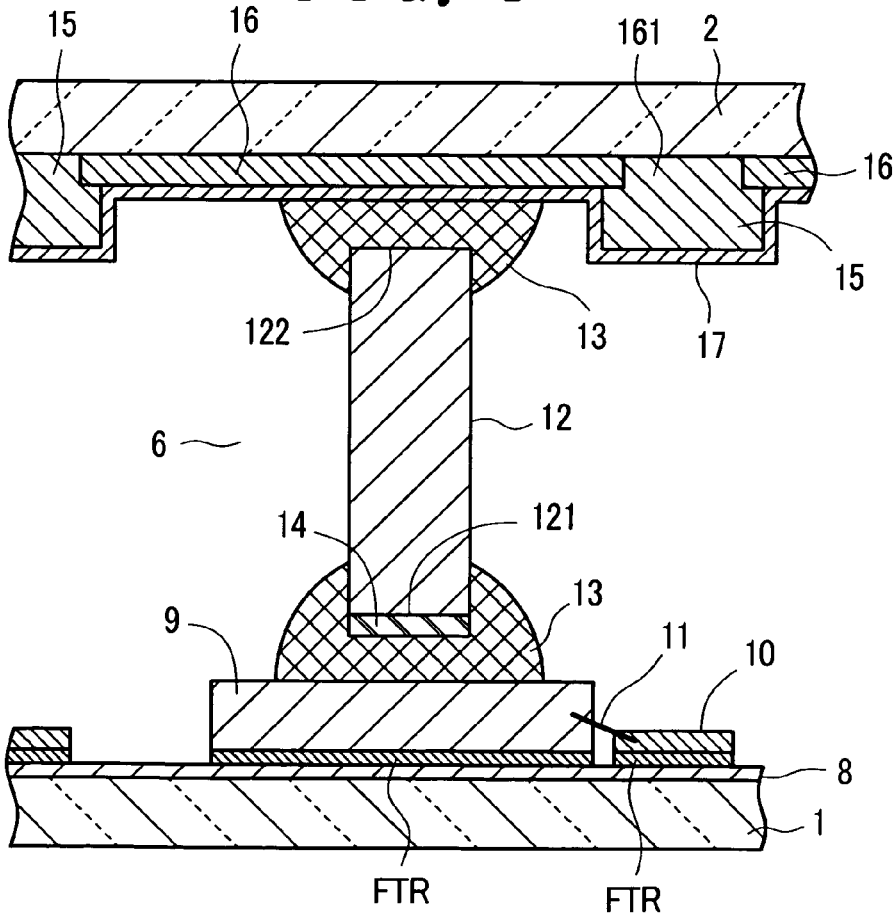
FIG. 4 is an enlarged schematic cross-sectional view of an essential part in FIG. 3.

FIG. 1A to FIG. 4 are views for explaining an embodiment 1 of an image display device according to the present invention, wherein FIG. 1A is a plan view of the image display device as viewed from a face substrate side, FIG. 1B is a side view of the image display device as viewed from the direction A in FIG. 1A, FIG. 2 is a schematic plan view of a back substrate by removing a face substrate shown in FIG. 1, FIG. 3 is a schematic cross-sectional view of the back substrate and the portion of a face substrate corresponding to the back substrate along a line B-B in FIG. 2, and FIG. 4 is an enlarged schematic cross-sectional view of an essential part in FIG. 3.

In these FIG. 1A to FIG. 4, symbol 1 indicates a back substrate and symbol 2 indicates a face substrate, wherein both substrates 1, 2 are formed of a glass plate having a thickness of several mm, for example, approximately 3 mm. Numeral 3 indicates a support body which is formed of a glass plate or a sintered body made of frit glass having a thickness of several mm, for example, approximately 3 mm. Numeral 4 indicates an exhaust pipe and the exhaust pipe 4 is fixedly secured to the back substrate 1. The support body 3 is inserted between the above-mentioned substrates 1, 2 in a state that the support body 3 surrounds peripheral portions of the substrates 1, 2. The support body 3 is hermetically sealed to both substrates 1, 2 by way of a sealing material 5 such as frit glass.

A space which is surrounded by the support body 3, both substrates 1, 2 and the sealing material 5 is evacuated through the exhaust pipe 4 thus constituting a display region 6 holding a degree of vacuum of, for example, $10^{-3}$ to $10^{-5}$ Pa. Further, the exhaust pipe 4 is mounted on an outer surface of the back substrate 1 mentioned previously and is communicated with a through hole 7 which is formed in the back substrate 1 in a penetrating manner. After completing the evacuation, the exhaust pipe 4 is sealed. Numeral 8 indicates an image signal lines and these image signal lines 8 extend in the Y direction and are arranged in parallel in the X direction on an inner surface of the back substrate 1. Numeral 9 indicates scanning signal lines and these scanning signal lines 9 extend in the X direction which crosses the image signal lines 8 and are arranged in parallel in the Y direction over the image signal lines 8. Numeral 10 indicates electron sources, wherein the electron sources 10 are formed in the vicinity of respective intersecting portions of the scanning signal lines 9 and the image signal lines 8, and the scanning signal lines 9 and the electron sources 10 are connected with each other by connection electrodes 11.

Here, the image signal lines 8 are formed of an Al/Nd film, for example, while the scanning signal lines 9 are formed of an Ir/Pt/Au film or the like.

Next, numeral 12 indicates spacers, wherein the spacers 12 are constituted of a ceramic material and are shaped in a rectangular thin plate shape. In this embodiment, the spacers 12 are arranged upright above the scanning signal lines 9 every other line, and are fixed to both substrates 1, 2 using an adhesive material 13. The spacers 12 are usually arranged at positions which do not impede operations of pixels for every plurality of respective pixels.

Sizes of the spacers 12 are set based on sizes of substrates, a height of the support body 3, a material of the substrates 1, 2, the displacement gaps of the spacers 12, a material of spacers 12 and the like. In general, the height of the spacers 12 is approximately equal to a height of the above-mentioned support body 3, a thickness of the spacers 12 is set to several 10 μm or more to several mm or less, and a length of the spacers 12 is set to approximately 20 mm to 200 mm. Preferably, a practical value of the length of the spacers 12 is approximately 8 mm to 120 mm.

Further, the spacers 12 possess a resistance value of approximately $10^8$ to $10^9$ Ωm.

Next, the adhesive material 13 has the conductive property and is formed of a conductive adhesive material which contains adhesive frit glass or a vitrified glass component, for example, and silver, for example. The spacers 12 and both substrates 1, 2 are adhered and fixed to each other using the adhesive material 13. Although a thickness of the adhesive material 13 may depend on the composition thereof, the thickness is set to ten and some μm or more, preferably approximately 20 to 40 μm from a viewpoint of ensuring adhesion and fixing.

Figure 5:
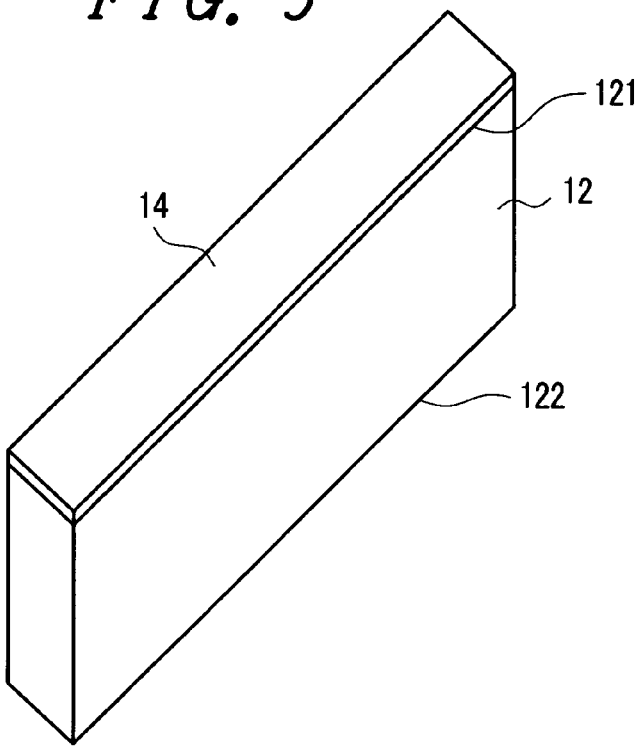
FIG. 5 is a perspective view showing one example of a spacer used in an image display device of the present invention.

Further, numeral 14 indicates a conductive film formed of an aluminum film. The conductive film 14 is formed over a whole length and a whole surface of the bottom surface 121 of the spacer 12 as shown in FIG. 5 as an example. The conductive film 14 is arranged to face the scanning signal line 9 in an opposed manner thus facilitating the formation of a discharge circuit from the face substrate 2 on a high voltage side to a back substrate 1 side on a low voltage side.

Further, the conductive film 14 is covered with the adhesive material 13 in a state that the adhesive material 13 shields the conductive film 14 from the high voltage side in the inside of the display region 6.

The conductive film 14 is formed by a means such as vapor deposition, printing or the like, for example, and has a resistance value of approximately 1 to 100Ω. As a constituting material of the conductive film 14, the above-mentioned aluminum is preferably used from a viewpoint of easiness of handling, a low cost and the like. However, besides aluminum, chromium (Cr), gold (Au), silver (Ag), platinum (Pt) or the like can be used in the same manner as aluminum.

Here, FIG. 5 is a perspective view showing one example of the spacer used in the image display device of the present invention, wherein parts identical with the parts shown in the above-mentioned drawing are given the same symbols.

Further, a top surface 122 side of the spacer 12 is configured not to have the above-mentioned conductive film 14 and is fixed to an anode electrode of the face substrate 2 described later using the above-mentioned adhesive material 13.

On an inner surface of the face substrate 2, phosphor layers 15 of red, green and blue are arranged in a state that these phosphor layers 15 are defined by a light-shielding BM (black matrix) film 16, and a metal back (an anode electrode) 17 made of a metal thin film is formed to cover the phosphor layers 15 and the BM film 16 by a vapor deposition method, for example, thus forming a phosphor screen.

With respect to these phosphors, $Y_2O_2S$:Eu(P22-R) is used as the red phosphor, ZnS:Cu,Al(P22-G) is used as the green phosphor, and ZnS:Ag,Cl(P22-B) is used as the green phosphor.

With such phosphor screen constitution, electrons irradiated from the above-mentioned electron source 10 are accelerated and impinge on the phosphor layers 15 which constitute the corresponding pixels. Accordingly, the phosphor layer 15 emits light of the given color and the light is mixed with an emitted light of color of the phosphor of another pixel thus constituting the color pixel of a given color.

Further, although the anode electrode 17 is indicated as a face electrode, the anode electrode 17 is formed of stripe-like electrodes which are divided for every pixel column while intersecting the scanning signal lines 9.

In this embodiment, the phosphor layer 15 is arranged to extend over the BM film 16 outside an opening portion 161 of the BM film 16 substantially about the opening portion 161. The phosphor layers 15 are spaced apart in both of X, Y-directions by the BM film 16 in a state that the phosphor layers 15 are arranged in a dotted pattern. Here, the size of the phosphor layer 15 may differ among the phosphor layers 15 of three colors.

Due to such a constitution of this embodiment 1, it is possible to form a discharge circuit from the high voltage side to the low voltage side with the use of the conductive film 14 formed on the low voltage side of the spacer 12. Accordingly, the charging of the spacers 12 can be reduced and hence, the trajectories of electrons can be ensured thus allowing the electrons sufficient for exciting the phosphor layers 15 to impinge on the phosphor layers 15 whereby it is possible to obtain the image display device which can enhance the brightness and can exhibit the excellent color reproducibility.

Further, by adopting the constitution which allows the adhesive material 13 to cover the conductive film 14, it is possible to prevent the undesired short-circuiting with the high voltage side. Further, the occurrence of spark can be prevented thus enhancing the breakdown strength characteristics.

Further, due to the prevention of charging of the spacers 12, the breakdown strength characteristics between both substrates 1, 2 can be enhanced thus prolonging the lifetime.

Still further, even in case there exists a portion where the spacer 12 and the scanning signal line 9 are not partially electrically connected, by arranging the conductive film 14, the conduction between the spacer 12 and the scanning signal line 9 is stabilized thus constituting the energizing circuit from the high voltage side to the low voltage side of the spacer 12. Further, in a step in which a space defined by both substrates 1, 2 and the support body 3 is evacuated, by applying a voltage between the anode electrode 17 and the scanning signal line 9 for a given time, the vicinity of the conductive film 14 which is electrically connected with the scanning signal line 9 through the conductive adhesive material 13 locally assumes a self-heating state thus enhancing a gas emission effect in the vicinity of the conductive film 14 and the emission of gas during the evacuation is accelerated whereby the evacuation efficiency is enhanced. Further, since the gas is emitted during the evacuation, it is possible to prevent the re-absorption of the emitted gas whereby the high vacuum can be ensured thus realizing the prolonged lifetime of the image display device.

Embodiment 2

Figure 6:
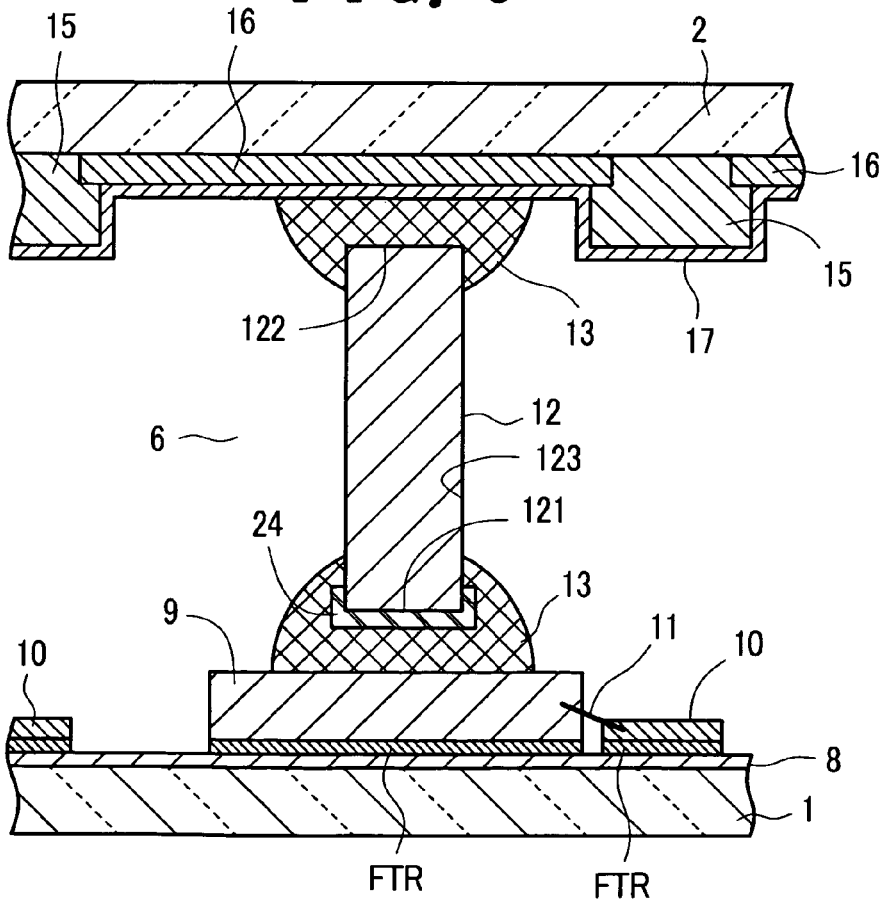
FIG. 6 is a schematic cross-sectional view similar to FIG. 4 showing another embodiment of the image display device of the present invention.

FIG. 6 is a schematic cross-sectional view similar to FIG. 4 showing another embodiment of the image display device of the present invention, wherein parts identical with the parts shown in the above-mentioned drawings are given same symbols.

In FIG. 6, the constitution in which a spacer 12 includes a conductive film 24 on a bottom surface 121 on a back substrate 1 side is equal to the constitution of the above-mentioned embodiment. In this embodiment 2, however, the conductive film 24 is arranged such that the conductive film 24 continuously extends to side walls 123 of the spacer 12.

It is needless to say that, also in this embodiment 2, the conductive film 24 is covered with an adhesive material 13 thus preventing the exposure of the conductive film 24 in the inside of the display region 6.

According to the constitution of this embodiment 2, by widening an area of spacer 12 to which the conductive film 24 is applied compared to the above-mentioned embodiment 1, it is possible to obtain the excellent manner of operation and effects substantially equal to or more than the manner of operation and effects of the embodiment 1.

Further, informing the conductive film 24, it is possible to use an immersion method which can be performed at a low cost while exhibiting the excellent mass-production property. It is needless to say that a vapor deposition method and a printing method can be also used.

Embodiment 3

Figure 7:
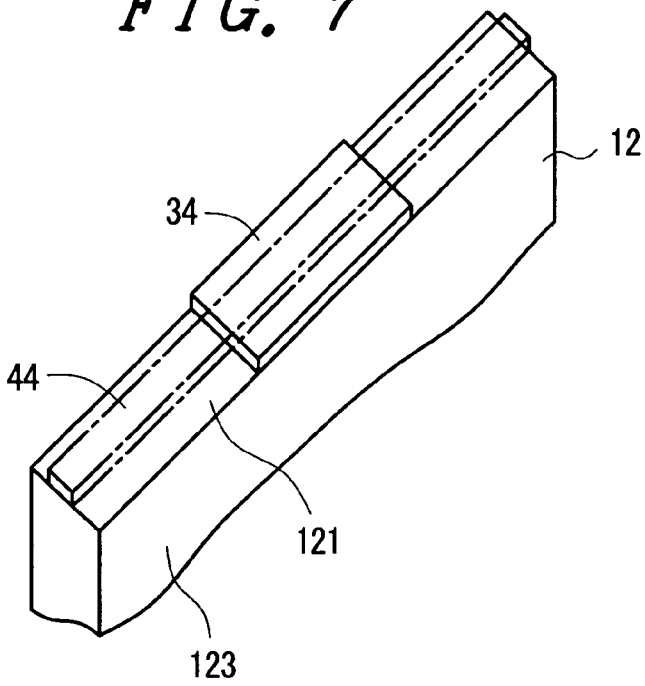
FIG. 7 is a perspective view showing another example of a spacer used in an image display device of the present invention.

FIG. 7 is a perspective view of another example of the spacer used in the image display device of the present invention, wherein parts identical with the parts shown in the above-mentioned drawings are given same symbols.

In FIG. 7, a spacer 12 is configured to include a conductive film 34 only on a portion of an approximately center portion along a total length of a bottom surface 121 thereof.

Further, the constitution indicated by a chained line is the constitution which forms a conductive film 44 on a portion along a width of the bottom surface 121 of the spacer 12.

According to the constitution of this embodiment 3, it is possible to obtain the excellent manner of operation and effects substantially equal to or more than the manner of operation and effects of the above-mentioned embodiments 1 and 2. Further, the image display device can be manufactured at a low cost.

Embodiment 4

Figure 8:
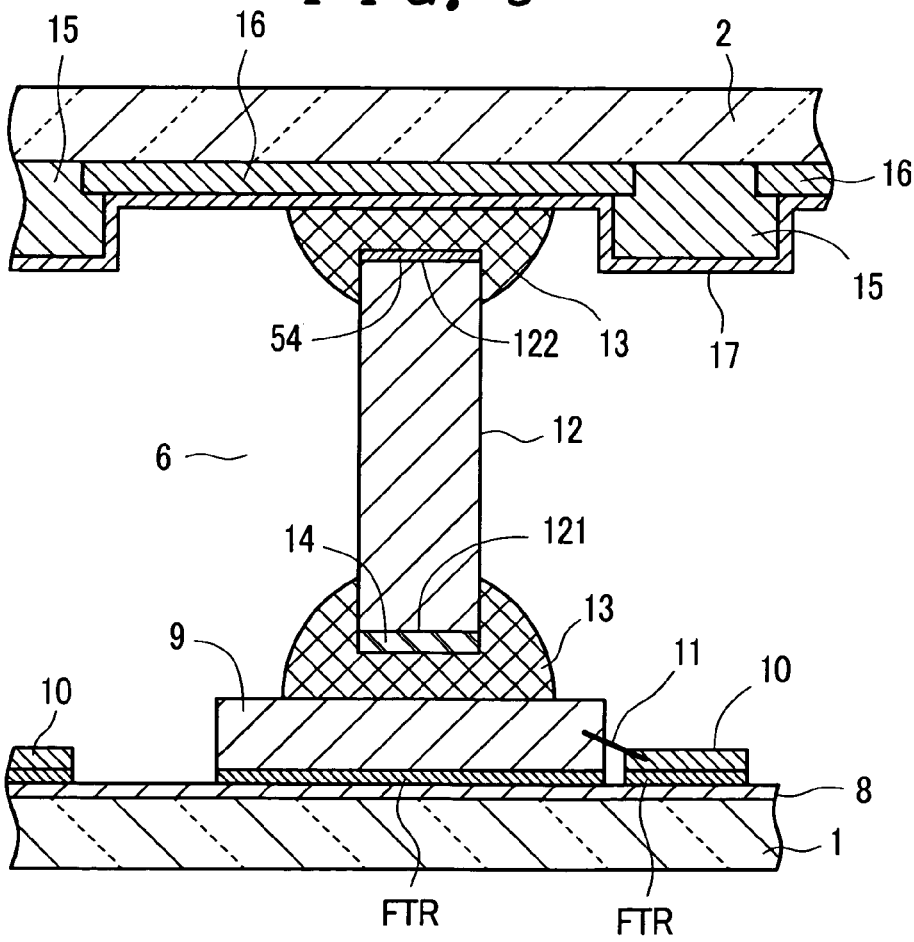
FIG. 8 is a schematic cross-sectional view similar to FIG. 4 showing another embodiment of the image display device of the present invention.

FIG. 8 is a schematic cross-sectional view similar to FIG. 4 showing another embodiment of the image display device of the present invention, wherein parts identical with the parts shown in the above-mentioned drawings are given same symbols.

In FIG. 8, the constitution in which a spacer 12 includes a conductive film 14 on a bottom surface 121 on a back substrate 1 side is equal to the constitution of the above-mentioned embodiment. In this embodiment 4, however, a thin film layer 54 is formed on a top surface 122 of the spacer 12 on a face substrate 2 side.

The thin film layer 54 possesses the low conductive property compared to the conductive film 14 on a bottom surface side and, for example, an insulation film may be used as the thin film layer 54.

It is needless to say that, also in this embodiment 4, the conductive film 14 is covered with an adhesive material 13 and hence, the conductive film 14 is not exposed in the inside of a display region 6.

According to the constitution of this embodiment 4, it is possible to obtain the manner of operation and effects substantially equal to the manner of operation and effects of the above-mentioned embodiments 1 to 3. Further, this embodiment also obtains an advantageous effect that a potential gradient can be made gentle.

Embodiment 5

Figure 9:
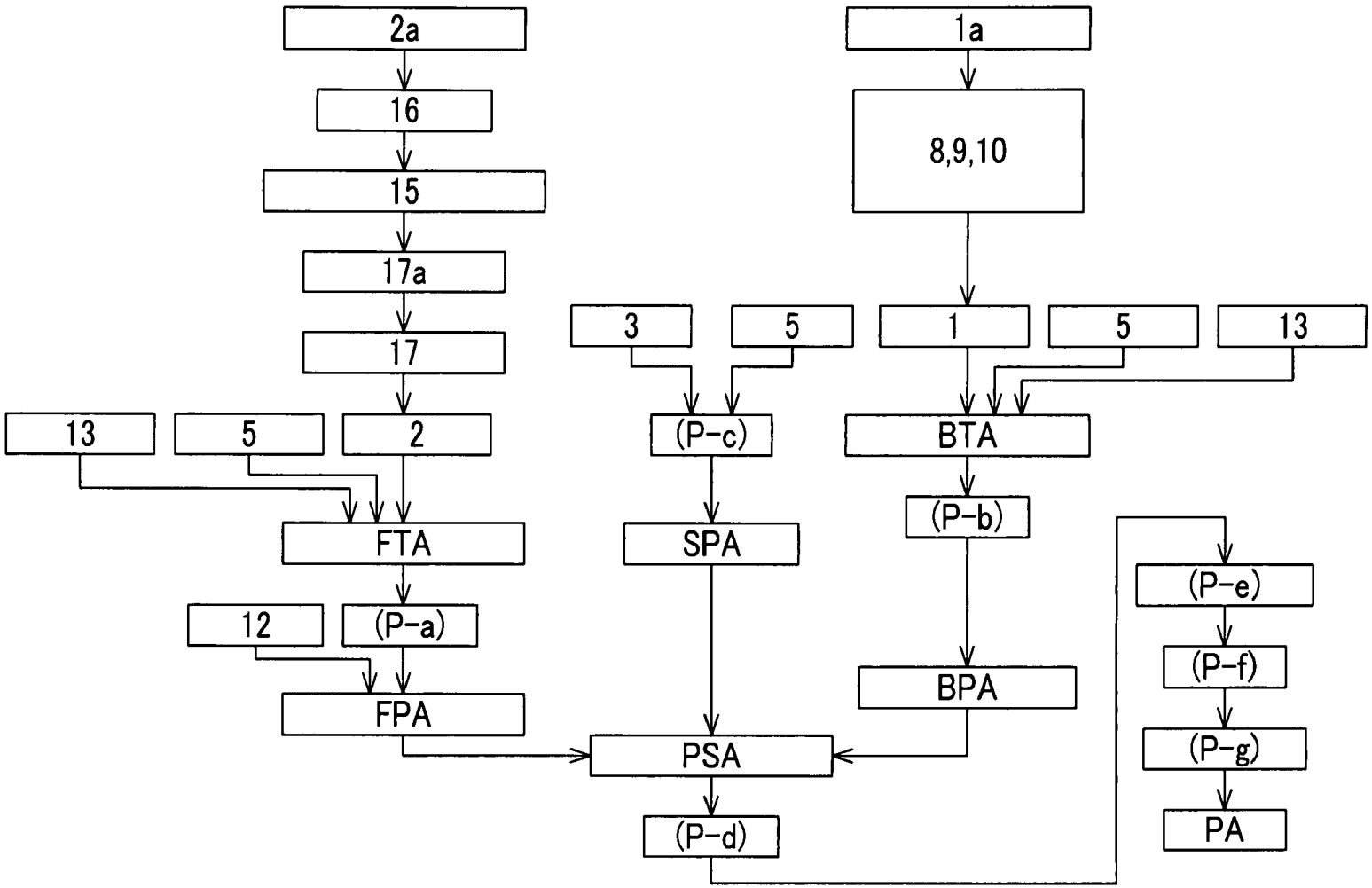
FIG. 9 is a flow chart for explaining a manufacturing method of the image display device of the present invention.

The manufacturing method of the image display device according to the present invention is explained. FIG. 9 is a flow chart for explaining the manufacturing method of the image display device according to the present invention, wherein parts identical with the parts shown in FIG. 1A to FIG. 8 are given the same symbols. In FIG. 9, the face substrate 2 is configured such that the phosphor screen which is formed of the BM film 16, the phosphor pattern 15 and the metal back (anode) 17 is formed on the substrate-forming glass 2*a*. Here, between a step for forming the phosphor layers 15 and a step for forming the metal back film 17, a step in which a background film 17*a* which is served for smoothing the metal back film 17 is formed is provided. This step is a manufacturing step which is provided for reducing an adverse effect to the metal back film 17 attributed to the unevenness of the phosphor layers 15. Although the background film 17*a* per se is dissipated by a heating step which is performed later, the step may become a cause for generating a residual gas. To the face substrate 2 having such a constitution, the sealing material 5 which is prepared by mixing the amorphous frit glass and given binder and the adhesive material 13 which is prepared by mixing frit glass and given binder, for example, for fixing the top surfaces 122 of the spacers 12 to the face substrate 2 are applied in given patterns respectively thus forming a face-substrate provisional assembly FTA.

Here, it is possible to form all sealing material 5 on the support body 3 side without forming the sealing material 5 on the substrate. The face-substrate provisional assembly FTA is dried at a temperature of approximately 150° C. around which a solvent contained in the binder is dissipated (P-a). Thereafter, the adhesive material 13 and the spacers 12 are positioned using a jig (not shown in the drawing) and, subsequently, are heated under atmosphere at a temperature of 450° C. for 10 minutes, for example, thus fixing the top surfaces 122 of the spacers 12 to the face substrate 2 by way of the adhesive material 13 whereby the face-substrate assembly FPA is formed.

On the other hand, at the back substrate 1 side, on the back-substrate-use glass 1*a*, the plurality of image signal lines 8 which extend in one direction, for example, the Y direction and are arranged in parallel in another direction which intersects the above-mentioned one direction, for example, the X direction, the plurality of scanning signal lines 9 which extend in another direction, for example, the X direction and are arranged in parallel in the above-mentioned one direction which intersects the another direction, for example, the Y direction, and the electron sources 10 are formed. Thereafter, the above-mentioned adhesive material 13 and sealing material 5 which are mixed with given binders respectively are applied to and formed on the back-substrate-use glass 1*a* at a given pattern thus forming a back-substrate provisional assembly BTA.

Here, the adhesive materials 13 which differ in characteristics may be used on the back-substrate 1 side and on the face-substrate 2 side respectively. The back-substrate provisional assembly BTA is dried at a temperature of approximately 150° C. around which a solvent contained in the binder is dissipated (P-b) thus forming a back-substrate assembly BPA.

On the other hand, the above-mentioned sealing material 5 is applied to both upper and lower end surfaces of the support body 3 and is dried at a temperature of approximately 150° C. around which a solvent contained in the binder is dissipated (P-c) thus forming a support assembly SPA.

Next, three assemblies consisting of the face-substrate assembly FPA which fixes the top surfaces 122 of the spacers 12 to the face substrate 2, the back-substrate assembly BPA and the support assembly SPA are overlapped to each other in the Z direction thus forming a panel provisional assembly PSA. In a state that the panel provisional assembly PSA is pressurized in the Z direction, the panel provisional assembly PSA is heated at a temperature of 430° C. for 10 minutes, for example (P-d), so as to hermetically seal both substrates 1, 2 and the support body 3 (P-e). Along with such hermetic sealing, the bottom surfaces 121 of the spacers 12 are fixed to the back substrate 2 by way of the conductive films 14 and the adhesive material 13.

Next, the space which is surrounded by both substrates 1, 2 and the support body 3 and defines the display region 6 is subjected to evacuation baking by way of the exhaust pipe 4 (P-f). This evacuation baking is a step in which, for example, the panel provisional assembly PSA is arranged in the inside of a vacuum furnace and is baked at a maximum temperature which is lower than softening temperatures of the sealing material 5 and the sealing material 13, for example, 380° C. for several hours. Further, in a method which does not use an exhaust pipe, the evacuation baking step and the hermetic sealing step may be performed simultaneously.

During this evacuation baking, a voltage equal to an operational voltage is applied between both substrates 1, 2 (between the anode 17 and the scanning signal lines 9). By performing the application of voltage during the evacuation step at a temperature of 100° C. or more in the midst of lowering of the baking temperature, it is possible to enhance the gas emission efficiency due to the local heating of the vicinity of the conductive film 14 of the spacer 12. To consider the reduction of cost of an evacuation facility, it is preferable that the atmospheric temperature at the time of applying voltage during the evacuation step falls within a range of 100° C. to 150° C.

Further, when the present invention adopts the constitution in which a thin film layer 54 having the conductive property is formed on a top surface 122 on the face substrate 2 side of the spacer 12 described in the above-mentioned embodiment 4, due to the application of the voltage during the evacuation step, the vicinity of the thin film layer 54 is also locally heated and hence, it is possible to efficiently emit not only gas attributed to the adhesive material 13 of the face substrate 2 side but also the residual gas generated from the background film 17*a* of the above-mentioned metal back film 17.

Thereafter, in the constitution provided with the exhaust pipe, the tip-off of the exhaust pipe is performed after completing the evacuation. Thereafter, by making the panel provisional assembly PSA to pass through given further processing such as aging (P-g), it is possible to manufacture the panel assembly body PA of the image display device.

According to such a manufacturing method, the vicinity of the conductive film of the spacer is locally heated thus enhancing the gas emission efficiency of the vicinity or the re-absorption of gas which is once discharged can be prevented whereby the high vacuum is obtained and the image display device can prolong the lifetime thereof.

What is claimed is:

1. An image display device comprising:

a face substrate which has phosphor layers and an anode electrode on an inner surface thereof;

a back substrate which forms electron sources on an inner surface thereof and faces the face substrate in an opposed manner with a given distance therebetween;

a support body which is interposed between the face substrate and the back substrate in a state that the support body surrounds a display region and holds the given distance;

a plurality of distance holding members which are arranged in the display region between the face substrate and the back substrate;

an adhesive material which adheres end surfaces of the distance holding members to the face substrate and the back substrate respectively; and a sealing material which hermetically seals end surfaces of the support body and the face substrate and the back substrate respectively, wherein the distance holding members are provided with a conductive film on a back substrate side thereof, and the conductive film is covered with the adhesive material and is not exposed to the inside of the display region wherein the conductive film is formed on a bottom surface of the distance holding member which faces the back substrate in an opposed manner and is arranged on the distance holding member in a state that the conductive film extends to side surfaces from the bottom surface of the distance holding member.

2. An image display device according to claim 1, wherein the back substrate includes a plurality of scanning signal lines which extend in one direction, are arranged in parallel in another direction which is orthogonal to one direction and to which a scanning signal is sequentially applied in another direction, a plurality of image signal lines which extend in another direction and are arranged in parallel in one direction to intersect the scanning signal lines, the electron sources which are formed in the vicinity of respective intersecting portions of the scanning signal lines and the image signal lines, and energizing electrodes which connect the electron sources and the scanning signal lines.

3. An image display device according to claim 2, wherein the distance holding members are arranged to extend in the same direction as the scanning signal lines in a state that the distance holding members are overlapped to the scanning signal lines.

4. An image display device according to claim 1, wherein the adhesive material has the conductive property.

5. An image display device according to claim 1, wherein the conductive film possesses a resistance value of 1 to 100Ω.

6. An image display device according to claim 1, wherein the conductive film is made of aluminum.

7. An image display device according to claim 1, wherein the distance holding member possesses a resistance value of 108 to 109Ω.

8. An image display device according to claim 1, wherein the distance holding member is made of a ceramic material and has a total length of 200 mm or less.

9. An image display device according to claim 1, wherein the adhesive material includes frit glass.

10. An image display device comprising:

a face substrate which has phosphor layers and an anode electrode on an inner surface thereof;

a back substrate which forms electron sources on an inner surface thereof and faces the face substrate in an opposed manner with a given distance therebetween;

a support body which is interposed between the face substrate and the back substrate in a state that the support body surrounds a display region and holds the given distance;

a plurality of distance holding members which are arranged in the display region between the face substrate and the back substrate;

an adhesive material which adheres the distance holding members to the face substrate; and a sealing material which hermetically seals between the face substrate and the support body, and between the back substrate and the support body, wherein the distance holding members are provided with a thin film layer having conductivity on a face substrate side thereof, and the thin film layer is covered with the adhesive material and is not electrically coupled to the inside of the display region, wherein the thin film layer is formed on a top surface of the distance holding member which faces the face substrate in an opposed manner.

* * * * *